US006802092B1

(12) United States Patent
Klein

(10) Patent No.: US 6,802,092 B1
(45) Date of Patent: Oct. 12, 2004

(54) COMBINATION STOWAGE AND PILLOW ACCESSORY FOR GROUND PADS

(75) Inventor: Sheila M. Klein, Seattle, WA (US)

(73) Assignee: Cascade Designs, Inc., Seattle, WA (US)

( * ) Notice: Subject to any disclaimer, the term of this patent is extended or adjusted under 35 U.S.C. 154(b) by 123 days.

(21) Appl. No.: 09/752,969

(22) Filed: Dec. 29, 2000

Related U.S. Application Data

(60) Provisional application No. 60/173,624, filed on Dec. 29, 1999.

(51) Int. Cl.[7] ..... A45C 9/00
(52) U.S. Cl. ..... 5/420; 5/417; 5/419
(58) Field of Search ..... 5/417, 418, 419, 5/420

(56) References Cited

U.S. PATENT DOCUMENTS 5,785,219 A * 7/1998 Kraft ..... 224/576

* cited by examiner

*Primary Examiner*—Teri Pham Luu
*Assistant Examiner*—Fredrick Conley
(74) *Attorney, Agent, or Firm*—Graybeal Jackson Haley, LLP

(57) ABSTRACT

An accessory for ground pads that includes first and second panels attached to one another so as to form a pocket into which a portion of a ground pad can be inserted. The first portion incorporates an expansion zone of elastic material so that when soft items are place between the ground pad and the expansion zone, an elevated structure akin to a pillow is formed. The second portion includes at least one strap attached thereto so that when the ground pad is rolled for storage, the at least one strap can be used to retain the rolled state of the pad.

21 Claims, 3 Drawing Sheets

COMBINATION STOWAGE AND PILLOW ACCESSORY FOR GROUND PADS

Priority from U.S. provisional application No. 60/173,624 filed Dec. 29, 1999, is claimed.

FIELD OF THE INVENTION

The present invention concerns an accessory for stowable ground pads, and more particularly an accessory for ground pads that incorporates compression sack features with comfort enhancing features.

BACKGROUND OF THE INVENTION

In the field of adventure travel, performance of one's gear is of considerable importance. Performance includes adequate protection from the elements, durability, weight, and size. As technology in this field has progressed, consumers of adventure travel gear have demanded greater comfort from their gear as well as performance.

Recent efforts by manufacturers of such gear have focused on both performance issues as well as comfort issues. Cascade Designs, Inc., a leading manufacturer of adventure travel gear, has also engaged in such efforts, especially with respect to self-inflating ground pads. Products such as its THERM-A-REST'R® brand pad accessory provide a user of a ground pad with a fabric slip cover or sleeve to enhance the coefficient of friction between the user and the pad, a chair conversion kit, and means for maintaining the pad in a rolled, stowed form when not in use. This particular product is considered by many users as a substitute for separate compression straps since the compression straps remain with the pad and cannot be lost or misplaced.

In an effort to provide similar functionality as the THERM-A-REST'R® brand pad accessory in a form that did not include the other features that some users might consider unnecessary or undesirable for certain applications, the inventor of the instant invention identified certain core features that should be included in any related accessory. These features included utilization of compression straps or other means for maintaining a ground pad in a rolled or stowed form and enhancing the comfort and/or functionality of the ground pad. It was with these objectives in mind that the invention was conceived.

SUMMARY OF THE INVENTION

The present invention is directed to an accessory for a rollable ground pad comprising a first portion of flexible material having a first surface area and an expansion zone; a second portion of flexible material having a second surface area; and at least one strap securely affixed at a first end thereof to the second portion of flexible material and having securing means for engaging the second portion of flexible material at a second end thereof wherein at least part of the first portion of flexible material and at least part of the second portion of flexible material define a three sided pocket to receive a portion of the ground pad.

A first primary feature of the invention is the incorporation of one or more straps to retain a pad, in a rolled or stowed state, that has been inserted into the pocket. In a most basic form, at least one strap having a first end and a second end is attached to the second portion of flexible material wherein the first end has a first part of a two part fastening system and the second end may have a second part of a two part fastening system. In this basic form, the at least one strap may be completely attached to the second portion of flexible material, selectively attached at multiple locations, or attached at only one location. Moreover, it is not necessary that the second part of the two part fastening system be associated with the second end of the at least one strap: it may be attached directly to the second portion of flexible material. In this second alternative, the second part of the two part fastening system may be directly attached to the second portion of flexible material, thereby causing a part of the second portion of flexible material to act as a tension member in lieu of the at least one strap.

In a preferred embodiment and to prevent undesired stretch of the flexible material, a pair of straps is used to retain the pad. Each strap is attached at its first end to a first part of the second portion of flexible material and includes a first part of a two part fastening system. A portion of each strap distant from the first end, and preferably proximate to the second end thereof, is attached to a second part of the second portion of flexible material. Attached to the second end of each strap is the second part of the two part fastening system. Consequently when an inserted pad is rolled, the second portion of flexible material wholly surrounds the exposed major surface of the pad and the first part and the second part of the second portion of flexible material are thereby brought into close or overlapping proximity with each other; and the two parts of the fastening system are brought together, engaged, and retain the pad in the rolled, stowed state.

Another feature of the invention provides for an expansion zone located at the first flexible material. This zone is intended to receive various soft items for storage when the pad is in use as well as to provide a user with the equivalent of a pillow for increased comfort. An advantage of this configuration is that unlike a pillow, the expansion zone will not shift during use. The zone may be created by using a stretchable fabric as the first flexible material, or may be integrated into a portion of the flexible material or in lieu of part of the first flexible material.

Depending upon various considerations, the aforementioned zone is preferably attached to an outer part of the first flexible fabric material. In this manner, the structural integrity of the sleeve is not compromised, yet a means is provided for creating a pillow-like structure for the user's comfort. A gap is provided to permit the insertion and removal of soft goods into the pocket defined by the expansion zone material and the first portion of flexible material. Alternatively, part of the first portion of flexible material can be removed and replaced with an expansion zone, or the entire first portion can be the expansion zone. In most cases, the expansion zone will comprise a two-way stretchable material such as stretch fleece.

DETAILED DESCRIPTION OF THE INVENTION

Figure 3:
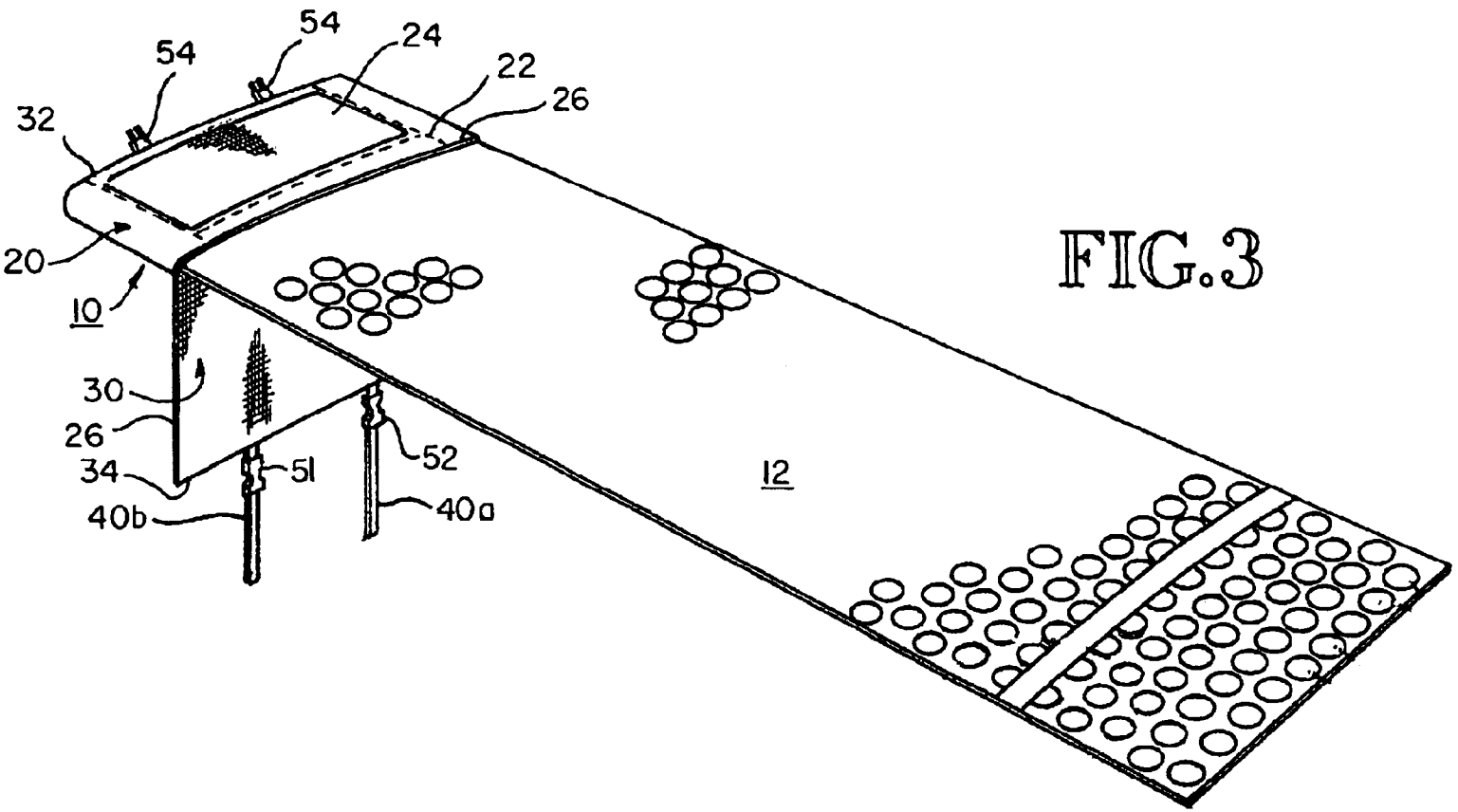
FIG. 3 is a perspective view of the invention shown in FIG. 1 wherein the ground pad is shown in a ready to use state.

Turning then to the several figures wherein like numerals indicate like parts, and more particularly to FIG. 3, the general parts of sleeve 10 shown surrounding pad 12 are set forth. As depicted therein, sleeve 10 has a first panel of flexible material 20 having expansion zone 24 and reinforcing perimeter 26; and a second panel of flexible material 30 having compression straps 40*a* and 40*b* and reinforcing perimeter 26. Preferably, a water resistant material such as treated nylon is selected for panels 20 and 30 while expansion zone 24 is preferably a stretch fleece material. Reinforcing perimeter 26 is present to prevent unintentional ripping or unraveling of panels 20 and 30.

It should be noted that for convenience, there are two portions of sleeve 10, namely an upper (anterior) portion and a lower (posterior) portion. In view of the nearly limitless methods of fabricating sleeve 10, either or both flexible panels 20 and 30 can be fabricated from a plurality of pieces of material, or both panels can be fashioned from a single piece of material. For convenience and in reference to this preferred embodiment, the upper portion is generally referred to as panel 20 while the lower portion is generally referred to as panel 30. However, and with reference to FIGS. 4 and 5, it can be seen that panel 30 actually extends over the lateral edge and forms a section of the upper portion of sleeve 10. Nevertheless, this upper portion is generally referred to as panel 20.

Figure 1:
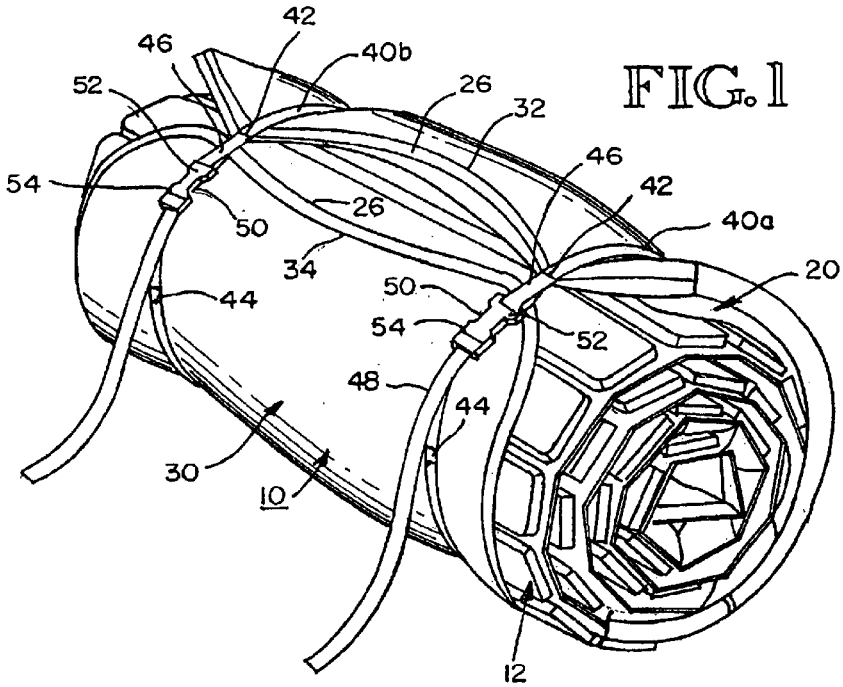
FIG. 1 is a perspective view of the invention shown engaged with a stowable ground pad illustrating the compression feature of the invention.
Figure 1A:
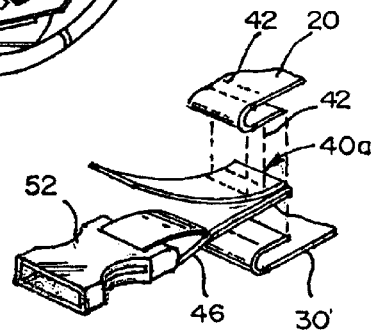
FIG. 1*a* is a detailed partial perspective view of a portion of the invention showing the integration of a compression strap portion with the fabric panels.
Figure 2:
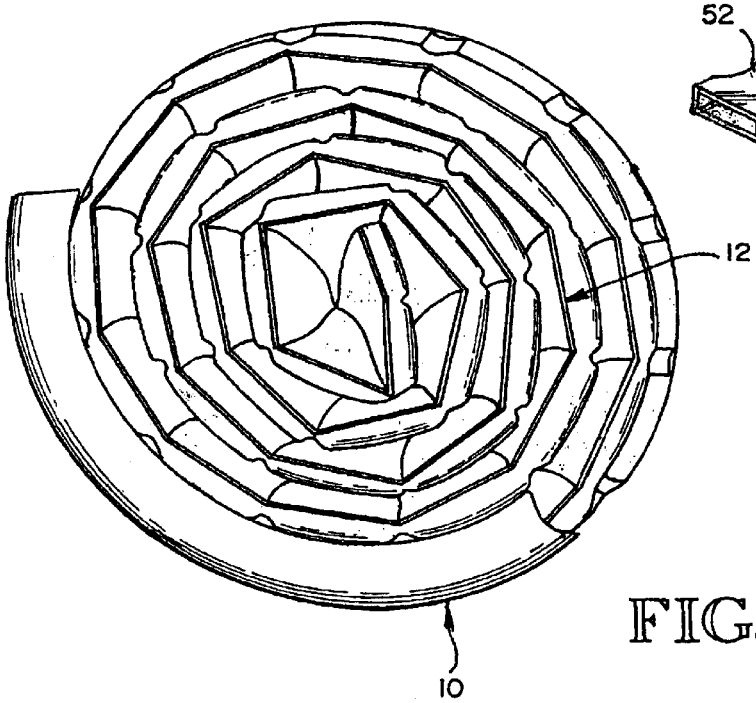
FIG. 2 is an end elevation of the invention shown in FIG. 1.

Returning then to FIGS. 1 and 1*a*, each strap 40 (specifically identified as straps 40*a* and 40*b* in the several drawings) has buckle assembly 50 consisting of female element 52 and male element 54. Female element 52 is preferably attached to first end 46 of strap 40, and male element 54 is preferably attached to second end 48 thereof. While any suitable means for securing a strap 40 to second panel 30 can be used, a preferred embodiment attaches first end 46 to the stitched interface between panel 20 and panel 30 as is best shown in FIG. 1*a*, and attaches second end 48 to panel 30 by way of stitching 44. In this manner, all tension forces present when the pad is in the stowed state are localized in straps 40*a* and 40*b* rather than being distributed to panels 20 and 30. However, any means for achieving this functionality are contemplated and include, generally, securing superior end 32 to inferior end 34 by way of snaps, buckles, slide fasteners, hook and loop fasteners, ties, etc.; removeably attaching end 48 directly to superior end 32 or end 46 of a strap 40; or removeably linking superior end 32 to inferior end 34 by a short strap.

Figure 4:
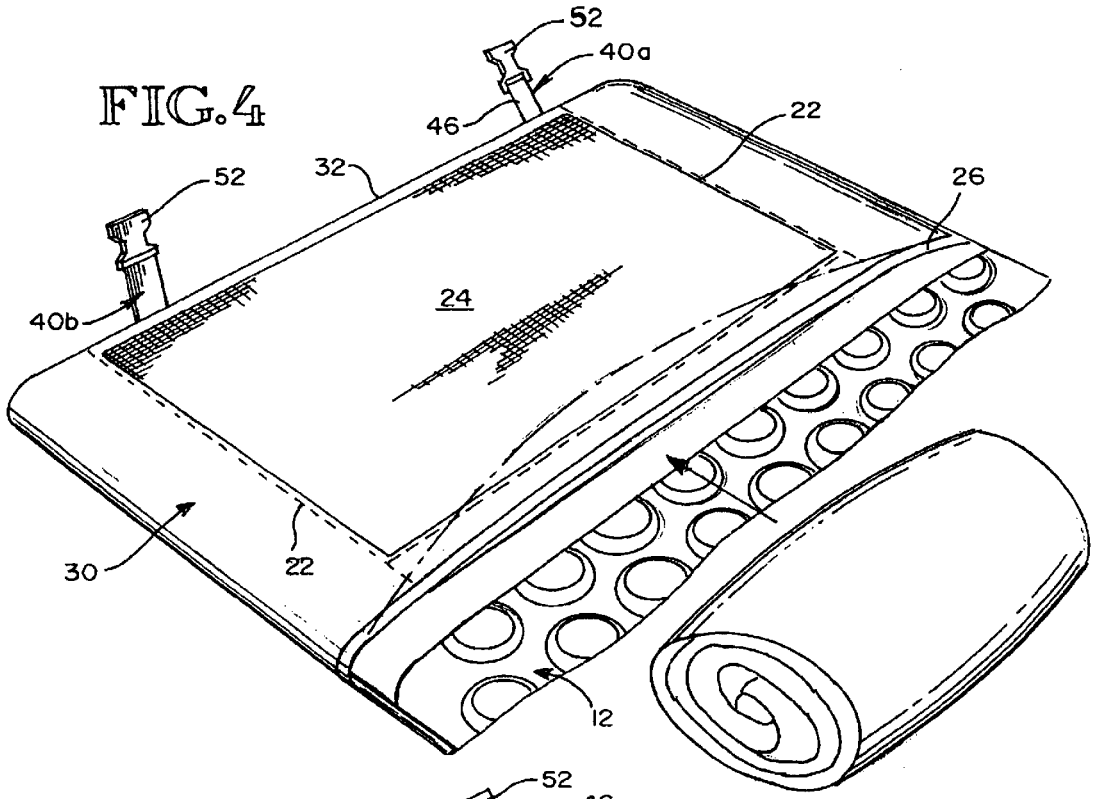
FIG. 4 is a detailed perspective view of the invention shown in FIG. 1 illustrating the nature of the expansion zone of the first flexible portion.
Figure 5:
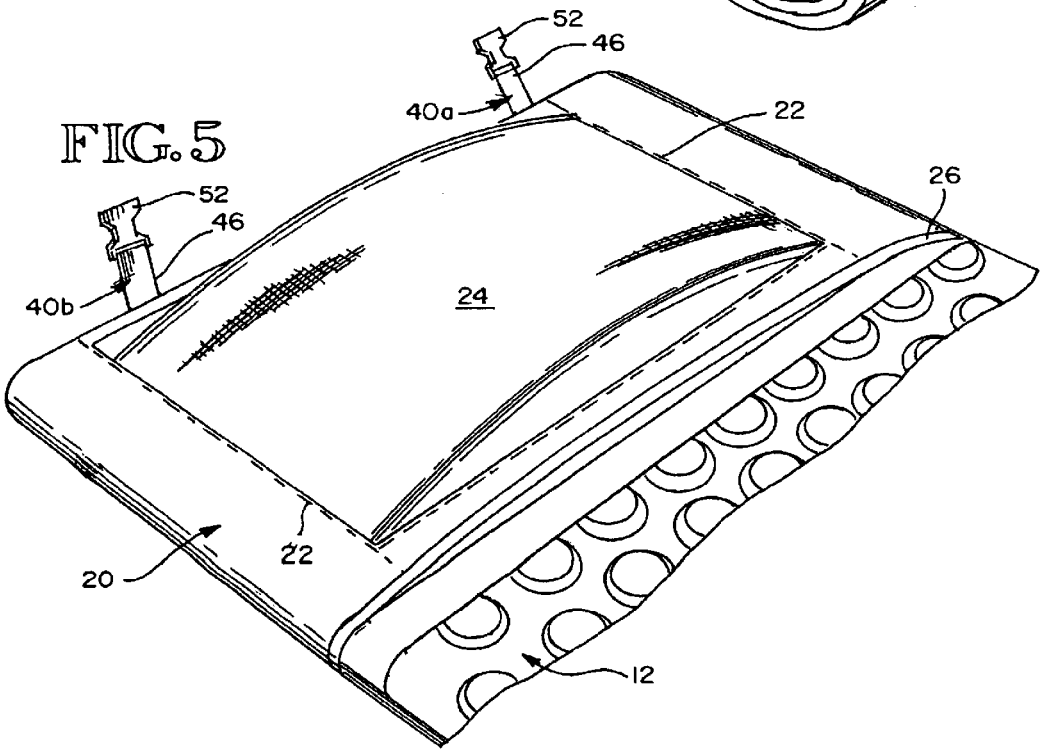
FIG. 5 is a detailed perspective view of the invention shown in FIG. 4 after insertion of soft goods into the expansion zone to create a pillow-type structure.

A notable feature of the invention is the incorporation of expansion zone 24 with panel 20. Turning specifically to FIGS. 4 and 5, it can be seen that expansion zone 24 is attached to panel 20 by way of stitching 22. Thus, when soft goods are placed in between a pad 12 inserted into sleeve 10 and expansion zone 24 as is shown in FIG. 4, a pillow-like structure similar to that shown in FIG. 5 is formed.

As pointed out previously, numerous possible manifestations exist for creating a structure similar to that shown in the several Figures. With respect to expansion zone 24, it is within the scope of the invention to fabricate panel 20 entirely from a stretch material, to overlay a stretch material on panel 20, or as illustrated, create a distinct expansion zone within an area defined by panel 20. It is also possible to construct all panels from a stretch material, however, certain performance limitations may militate against such a design selection.

What is claimed is:

1. An accessory for a rollable ground pad comprising:

a first portion of flexible material having a first surface area, a perimeter, and an expansion zone for supporting the head of a user;

second portion of flexible material having a second surface area fixedly attached to the first portion and defining a three sided pocket to receive a portion of the ground pad; and at least one strap securely affixed at a first end thereof to the second portion of flexible material and having securing means for engaging one of the first portion or the second portion of flexible material at a second end thereof.

2. The accessory of claim 1 wherein the securing means at the second end of the at least one strap for engaging one of the first portion or the second portion of flexible material is selected from the group consisting of hook material, loop material, a first part of a two part buckle, a first part of a two part snap, and a grommet or cord.

3. The accessory of claim 1 wherein receiving means are located on the second portion of flexible material for receiving the securing means.

4. The accessory of claim 3 wherein the receiving means are selected from the group consisting of hook material, loop material, a first part of a two part buckle, a first part of a two part snap, and grommet or cord.

5. The accessory of claim 1 wherein the expansion zone has multiple directional stretch properties greater than that of the first portion of flexible material.

6. The accessory of claim 1 wherein the second surface area is equal to or greater than the first surface area.

7. The accessory of claim 6 wherein the securing means at the second end of the at least one strap for engaging one of the first portion or the second portion of flexible material is selected from the group consisting of hook material, loop material, a first part of a two part buckle, a first part of a two part snap, and a grommet or cord.

8. The accessory of claim 6 wherein receiving means are located on the second portion of flexible material for receiving the securing means.

9. The accessory of claim 8 wherein the receiving means are selected from the group consisting of hook material, loop material, a first part of a two part buckle, a first part of a two part snap, and a grommet or cord.

10. The accessory of claim 6 wherein the expansion zone has multiple directional stretch properties greater than that of the first portion of flexible material.

11. An accessory for a rollable ground pad comprising:

a first portion of flexible material having a first surface area and an expansion zone for supporting the head of a user;

a second portion of flexible material having a second surface area fixedly attached to the first portion and defining a three sided pocket to receive a portion of the ground pad; and a first and a second strap, each having a first end and a second end, wherein the first end of the each strap is securely affixed to one of the first portion or the second portion of flexible material and the second end of each strap has securing means for engaging one of the first portion or the second portion of flexible material.

12. An accessory for a rollable ground pad comprising:

a first portion of flexible material having a first surface area, a perimeter, and an expansion zone for supporting the head of a user;

a second portion of flexible material having a second surface area and a perimeter wherein at least part of the second portion perimeter is non-removably attached to the first portion to define an open-ended pocket for receiving a portion of the ground pad; and at least one strap securely affixed at a first end thereof to the second portion of flexible material and having securing means for engaging one of the first portion or the second portion of flexible material at a second end thereof.

13. The accessory of claim 12 wherein the securing means at the second end of the at least one strap for engaging one of the first portion or the second portion of flexible material is selected from the group consisting of hook material, loop material, a first part of a two part buckle, a first part of a two part snap, and a grommet or cord.

14. The accessory of claim 12 wherein receiving means are located on the second portion of flexible material for receiving the securing means.

15. The accessory of claim 14 wherein the receiving means are selected from the group consisting of hook material, loop material, a first part of a two part buckle, a first part of a two part snap, and grommet or cord.

16. The accessory of claim 12 wherein the expansion zone has multiple directional stretch properties greater than that of the first portion of flexible material.

17. The accessory of claim 12 wherein the second surface area is equal to or greater than the first surface area.

18. The accessory of claim 17 wherein the securing means at the second end of the at least one strap for engaging one of the first portion or the second portion of flexible material is selected from the group consisting of hook material, loop material, a first part of a two part buckle, a first part of a two part snap, and a grommet or cord.

19. The accessory of claim 17 wherein receiving means are located on the second portion of flexible material for receiving the securing means.

20. The accessory of claim 19 wherein the receiving means are selected from the group consisting of hook material, loop material, a first part of a two part buckle, a first part of a two part snap, and a grommet or cord.

21. The accessory of claim 17 wherein the expansion zone has multiple directional stretch properties greater than that of the first portion of flexible material.

* * * * *